United States Patent [19]

Milloy

[11] Patent Number: 4,719,650

[45] Date of Patent: Jan. 19, 1988

[54] PACIFIER BIB

[76] Inventor: Mary E. Milloy, 2107 Pierce St., Apt. 5, San Francisco, Calif. 94115

[21] Appl. No.: 934,719

[22] Filed: Nov. 25, 1986

[51] Int. Cl.[4] ..... A41B 13/10

[52] U.S. Cl. ..... 2/49 R

[58] Field of Search ..... 2/49 R; 128/359; 224/148; D24/45

[56] References Cited

U.S. PATENT DOCUMENTS 298,985 5/1884 Kimball ..... 2/49 R
4,068,313 1/1978 Goldman ..... 2/49 R
4,473,907 10/1984 Maillard ..... 2/49 R
4,564,957 1/1986 Scharf ..... 2/49 R
4,604,758 8/1986 Grasberger et al. ..... 2/49 R

*Primary Examiner*—Louis K. Rimrodt
*Attorney, Agent, or Firm*—Phillips, Moore, Lempio & Finley

[57] ABSTRACT

A pacifier bib is formed from a flat panel of fabric having a wishbone shape. The bib includes a U-shaped collar adapted to have distal ends thereof attached together for encirclement around the neck of a child. An integral flap extends downwardly from the collar and is adapted to have its distal end folded over into a closed loop for attaching the handle of a pacifier to the bib.

7 Claims, 3 Drawing Figures

PACIFIER BIB

TECHNICAL FIELD

This invention relates to a child's pacifier bib, and more particularly to a bib adapted for attachment around the neck of a child to releasably support a pacifier therefrom.

BACKGROUND ART

The nipple of an orthodontic pacifier is designed to fit into a child's mouth to provide pacifying effects, as well as oral exercise for promoting healthy dental development. Recent studies have shown that pacifiers are equally useful to soothe premature infants as they undergo painful medical procedures.

A recurring problem accompanying the use of pacifiers is that a child will often-times drop the pacifier on a floor or the like to subject the pacifier and child to various pathogenic germs. In order to avoid disease or other morbid symptoms, the pacifier is normally washed and rinsed or otherwise sterilized for re-use by the child.

Prior attempts to prevent the child from dropping the pacifier have included the use of a cord, string, or tape attached to the pacifier and encircled about the child's neck. The child is thus subjected to possible strangulation. As a consequence, many companies, marketing orthodontic pacifiers, print a warning on their packaging to the effect that tying a pacifier around a child's neck with a cord may present a strangulation danger.

DISCLOSURE OF THE INVENTION

This invention overcomes the above, briefly described problems by providing an economical pacifier bib that is safe and easy to use.

In its broadest aspects, the pacifier bib comprises collar means for encirclement about a child's neck, and holder means extending downwardly from the collar means for releasably attaching a pacifier to the bib.

The pacifier bib is preferably formed from a flat panel, composed of a soft and flexible material, having a wishbone shape. The collar means preferably comprises a generally U-shaped collar having upwardly extending collar portions terminating at distal ends, adapted to be attached together. The holder means preferably comprises a flap extending downwardly from the collar. A distal end of the flap is adapted to be folded and attached to form a closed loop adapted to suspend the handle of a pacifier therefrom.

BRIEF DESCRIPTION OF THE DRAWINGS

Other advantages and objects of this invention will become apparent from the following description and accompanying drawings wherein.

BEST MODE OF CARRYING OUT THE INVENTION

Figure 1:
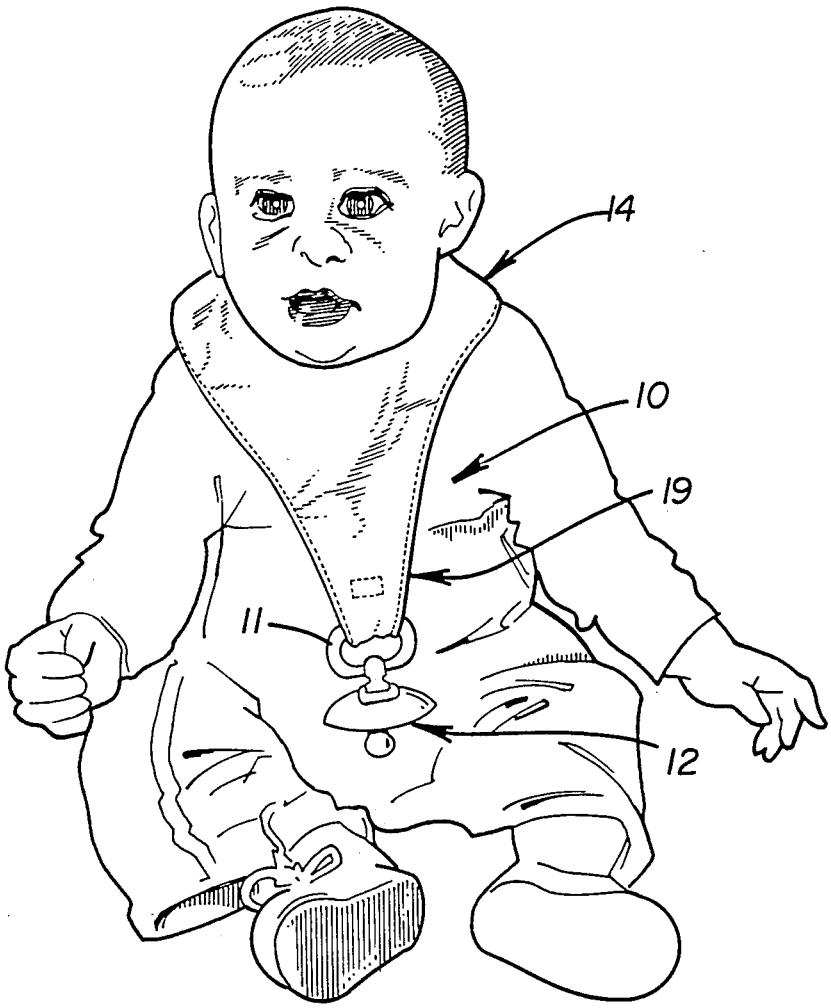
FIG. 1 illustrates a child having a pacifier bib of this invention encircling his neck and a pacifiier suspended from the bib.

FIG. 1 illustrates a child having a pacifier bib 10 of this invention encircling his neck. A closed handle 11 of a pacifier 12 is releasably attached to a lower end of the bib in suspended relationship thereon. Such attachment will insure that the pacifier will not be contaminated with germs when dropped onto a floor or the like.

Figures 2, 3:
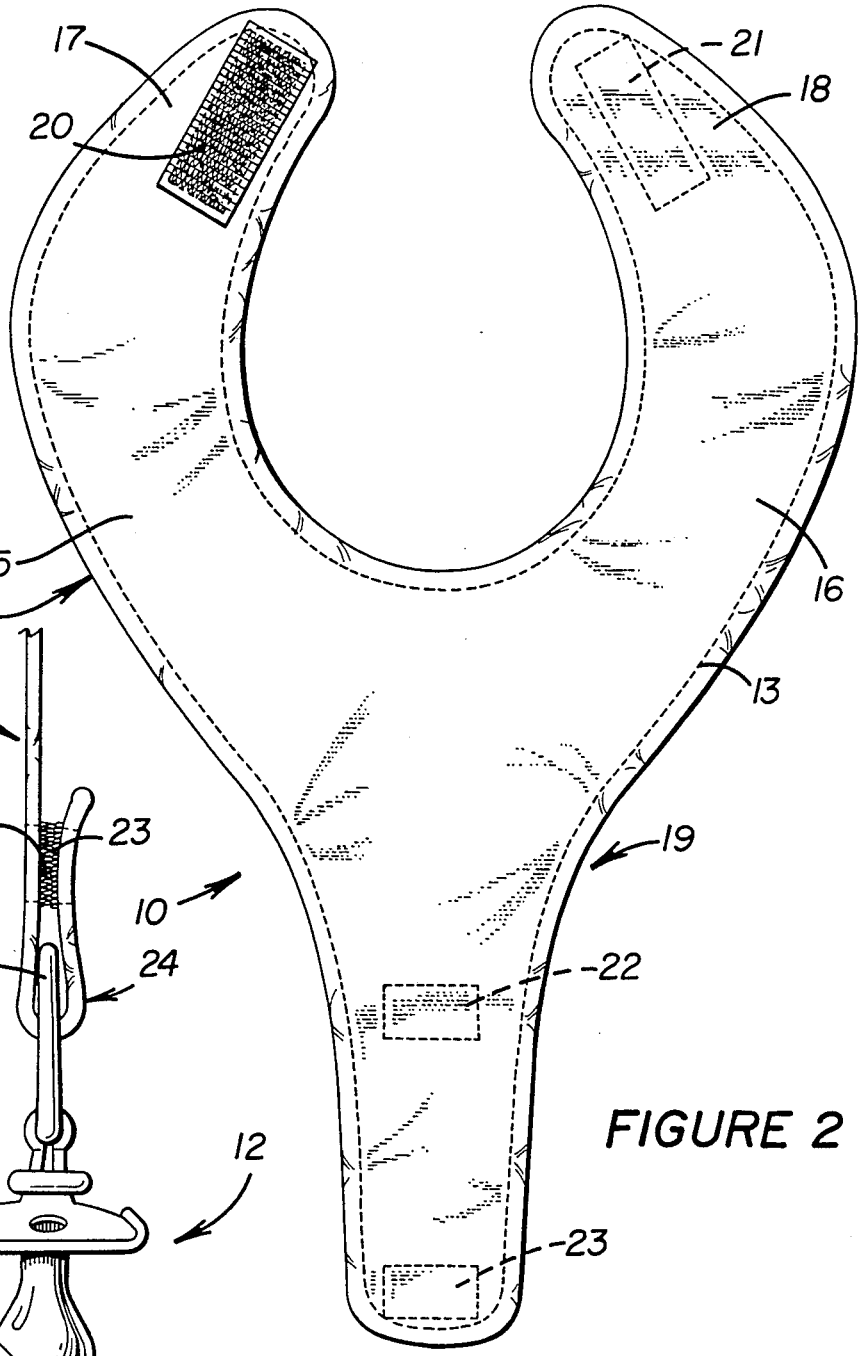
FIG. 2 is a top or frontal plan view of the pacifier bib in its opened and flattened condition; adn
FIG. 3 is a side elevational view of a closed loop of the pacifier bib, having the pacifier suspended therefrom.

Referring to FIG. 2, pacifier bib 10 is preferably composed of woven cloth fabric, such as standard quilting, that is soft, flexible and durable. The bib may be constructed from a pair of superimposed layers of material (cotton, synthetic or combination thereof) cut to the wishbone shape illustrated and stitched together at 13, around the entire periphery of the formed flat panel. The panel is thus formed to include a generally U-shaped collar 14 having upwardly extending collar portions 15 and 16, terminating at distal ends 17 and 18 thereof, respectively.

The panel further includes a flap 19 extending downwardly from a distal or lower end of the collar, intermediate collar portions 15 and 16. A fastening means, shown in the form of Velcro brand hook and loop fasteners 20 and 21, is adapted to releasably attach distal ends 17 and 18 of the collar portions together when the bib is encircled and attached around the neck of a child, as shown in FIG. 1. Fasteners 20 and 21 are secured on opposite sides of distal ends 17 and 18, respectively, to facilitate the attachment function.

A second fastening means, adapted to releasably attach handle 11 of pacifier 12 to flap 19, preferably comprises a pair of Velcro band hook and loop fasteners 22 and 23. The fasteners are secured in longitudinally spaced relationship on the same side of flap 19 to define a loop 24 (FIG. 3) when the fasteners are attached together. It should be noted that the fasteners are preferably attached together on a backside of the bib to thus "hide" the looped end of the flap.

In use, collar 14 (FIG. 2) is draped around the neck of a child and fasteners 20 and 21 are attached together whereby the collar will loosely encircle the neck. Handle 11 of pacifier 12 is then threaded onto the distal end of flap 19 and fasteners 22 and 23 are attached together to suspend the pacifier from the bib. The softness and substantial width of each collar portion 15 and 16 (e.g., two inches wide and one-eighth of an inch thick) and the substantial width of flap 19 (e.g., from two inches at its distal end to four inches at its juncture with collar 14) will prevent any possibility of the child choking.

In contrast thereto, should a standard cord be used to suspend a pacifier from a child's neck, the cord may tend to "wrap-around" the child's neck to thus subject the child to strangulation. The widths of collar portions 15 and 16 and flap 19 are substantially greater than their thicknesses (e.g., greater than ten times) to inhibit the bib from wrapping around a child's neck. In addition, the quick release feature inherent with Velcro brand fasteners 20 and 21, and also 22 and 23, will aid in preventing such strangulation.

It should be understood that various modifications, obvious to those skilled in the arts relating hereto, can be made to the pacifier bib without departing from the scope of the invention hereafter claimed. For example, collar 14 could be formed as an integral closed construction (without fasteners 20 and 21) whereby the collar would be slipped over the head of a child when put into use. However, the use of fasteners 20 and 21 for attaching collar portions 14 and 15 together has many obvious advantages over an integral construction. Further, other types of fasteners could be used, although the Velcro brand fasteners are particularly adapted for use in pacifier bib 10.

I claim:

1. A pacifier bib formed from a single and unitary flat panel of soft and flexible material having a wishbone shape comprising collar means for encirclement about a child's neck, holder means, including a flap extending directly downwardly from a lower end of said collar means, for releasably attaching a pacifier to said bib, first fastening means comprising hook and loop fasteners secured on opposite sides of the distal ends of said collar means for releasably attaching the distal ends of said collar means together, and second fastening means on a distal end of said flap, comprising hook and loop fasteners secured in longitudinally spaced relationship on the same side of said flap to define a loop when said latter fasteners are attached together, for releasably attaching said pacifier to said flap.

2. The pacifier bib of claim 1 further comprising a pacifier attached to said holder means.

3. A pacifier bib adapted for attachment around the neck of a child comprising a single and unitary flat panel of soft and flexible material having a general wishbone shape, a generally U-shaped collar defined in said panel and having upwardly extending and substantially wide collar portions terminating at distal ends, a flap defined in said panel and extending downwardly from a distal end of said collar, between said collar portions.

first fastening means, comprising hook and loop fasteners secured on opposite sides of the distal ends of said collar portions, for releasably attaching the distal ends of said collar portions together, and second fastening means on a distal end of said flap for releasably attaching a pacifier to said flap, said second fastening means comprising hook and loop fasteners secured in longitudinally spaced relationship on the same side of said flap to define a loop when said latter fasteners are attached together.

4. The pacifier bib of claim 3 wherein the width of each of said collar portions and said flap is substantially larger than the thicknesses thereof.

5. The pacifier bib of claim 4 wherein the width of each of said collar portions and said flap are at least approximately ten times the thicknesses thereof.

6. The pacifier bib of claim 3 wherein said material comprises a woven fabric.

7. The pacifier bib of claim 3 further comprising a pacifier attached to said flap by said second fastening means.

* * * * *